US007578065B2

(12) United States Patent
Brunner

(10) Patent No.: US 7,578,065 B2
(45) Date of Patent: Aug. 25, 2009

(54) DEVICES FOR DETERMINING THE STRING TENSION OF RACKET STRINGS

(76) Inventor: Adolf Brunner, Ennsweg 35, A-5550 Radstadt (AT)

( * ) Notice: Subject to any disclaimer, the term of this patent is extended or adjusted under 35 U.S.C. 154(b) by 280 days.

(21) Appl. No.: 11/804,281

(22) Filed: May 16, 2007

(65) Prior Publication Data

US 2007/0296207 A1 Dec. 27, 2007

(30) Foreign Application Priority Data

May 16, 2006 (EP) ..... 06010024

(51) Int. Cl.
*A63B 51/00* (2006.01)
*A63B 59/00* (2006.01)
*G06C 3/00* (2006.01)

(52) U.S. Cl. ..... 33/1 SD; 235/88 G; 473/553

(58) Field of Classification Search ..... 33/1 SD, 33/1 SB, 1 R, 562; 235/78 G, 88 G, 88 R, 235/1 B, 122; 116/222, 223; 473/553, 557; D10/46.1
See application file for complete search history.

(56) References Cited

U.S. PATENT DOCUMENTS 2,168,743 A * 8/1939 Herbert ..... 235/61 B
2,484,366 A * 10/1949 Wilson ..... 235/88 R
3,410,482 A * 11/1968 Strum ..... 235/88 R
4,160,327 A * 7/1979 Martin et al. ..... 33/512
4,248,458 A * 2/1981 Brody ..... 283/117
D388,341 S * 12/1997 Perez ..... D10/46.1
6,311,403 B1 * 11/2001 Macrini ..... 33/1 SD
6,569,040 B2 * 5/2003 Bradstock ..... 473/407

FOREIGN PATENT DOCUMENTS

EP 1857155 A1 * 11/2007

* cited by examiner

*Primary Examiner*—R. Alexander Smith
(74) *Attorney, Agent, or Firm*—Byrne Poh LLP; Matthew T Byrne

(57) ABSTRACT

Devices for determining the string tension of racket strings are provided. In some embodiments, devices for determining the string tension of racket strings comprise: a body having a front surface indicating different combinations of player and racket characteristics, windows corresponding to certain types of rackets, and an axis perpendicular to the front surface; and a rotary disc which is rotatably situated on the axis behind the front surface and which has numbers indicated thereon representing racket string tension values that can be viewed through the windows for the different combinations of player and racket characteristics.

6 Claims, 3 Drawing Sheets

DEVICES FOR DETERMINING THE STRING TENSION OF RACKET STRINGS

CROSS REFERENCE TO RELATED APPLICATION

This application claims the priority under 35 U.S.C. § 119 to European Patent Application No. EP06010024, filed May 16, 2006, which is hereby incorporated by reference herein in its entirety.

TECHNICAL FIELD

The disclosed subject matter relates to devices for determining the string tension of racket strings.

BACKGROUND

From experience, it is known that the behaviour of a tennis player during a game of tennis is influenced at a rate of 70 to 80% by the type of stringing of the player's tennis racket. While it is true that the frame and the handle of a tennis racket are important too, it must be pointed out that the stringing elasticity of the tennis racket, which is individually matched to the respective tennis player, is of paramount importance for a successful result of the game. The individual racket stringing elasticity, matched to the respective player, can only be determined, if at all, after lengthy testing periods. This is added to the fact that the opinions existing with respect to the suitability of a hard or more elastic type of stringing of the tennis racket to guarantee a greater success of the game largely deviate from each other. Up to the present, no device is known that could give a useful and predictable indication in this respect. Consequently, when it comes to the choice of a specific stringing elasticity of a tennis racket head, there will be a conflict of goals between the possibility of achieving high ball speeds when using a rather soft, elastic type of racket stringing and the desired increased ball control when using a harder stringing type.

SUMMARY

Devices for determining the string tension of racket strings are provided. In some embodiments, devices for determining the string tension of racket strings comprise: a body having a front surface indicating different combinations of player and racket characteristics, windows corresponding to certain types of rackets, and an axis perpendicular to the front surface; and a rotary disc which is rotatably situated on the axis behind the front surface and which has numbers indicated thereon representing racket string tension values that can be viewed through the windows for the different combinations of player and racket characteristics.

DETAILED DESCRIPTION

Devices for determining the string tension of racket strings are provided. In some embodiments, a device is provided that allows a user to preset a specific racket stringing elasticity that is adapted to the individual playing characteristics of the player. More particularly, in some embodiments, a device is provided for presetting the stringing elasticity of tennis rackets which is indicated and controlled by means of a stringing elasticity measuring device, pursuant to the pre-selection of the desired playing mode of the respective tennis player in terms of whether such mode is of a rather offensive, allround or defensive nature, and depending on the racket specification.

Figure 1:
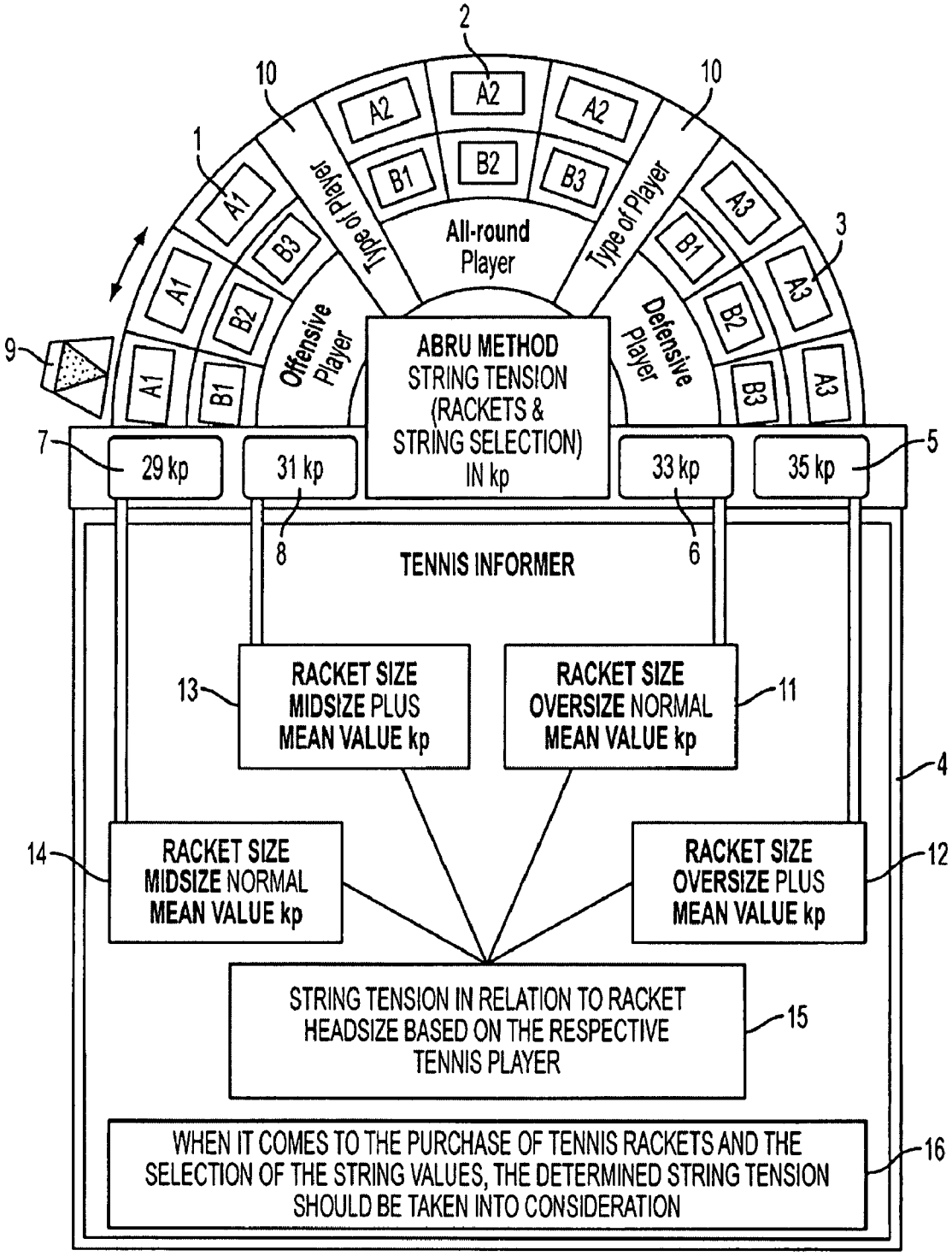
FIG. 1 is an illustration of the front of a device in accordance with some embodiments.

As shown in FIGS. 1-4, in some embodiments, a device that ensures the setting of the stringing elasticity of a tennis racket head, depending on the size of the tennis racket head, includes a body 4 as the basic element and a circular rotary disc 28 with a rotary head 9 which is firmly connected with the axis 29. The basic element is a hollow block, consisting of a solid bottom part A with an integrated front leg B and a rear leg C, which structure forms a cavity in which the rotary disc 28 is allowed to rotate. The rotary disc 28 is firmly connected with the axis 29. On its front side the rotary disc is provided with index numbers which are customary in tennis sports. On the other side, the front leg B is provided with the openings 5, 6, 7, and 8 matching the index numbers of the rotary disc, as illustrated in FIG. 1. The front side of the leg B is provided with indexed characteristic values with respect to the choice of the racket stringing elasticity and the string choice, depending on the individual playing mode, e.g., the offensive, the allround or the defensive playing mode. Depending on the setting of the rotary head 9 to the desired individual playing mode, the stringing elasticity values, which are adjustable in relation to the racket head size, are displayed in the windows 5, 6, 7, and 8.

FIG. 1 shows the front side of the device with the bottom part A of the body 4 with its leg B. The leg B shows the index range A1 for offensive players, the index range A2 for allround players and the index range A3 for defensive players. Leg B also shows the index range B1 for "top spin" players, index range B2 for "drives or slices" players, and index range B3 for "straight line and slice" players, which index ranges are described further in FIG. 2. When turning the rotary disc clockwise by means of the rotary head 9, the racket stringing elasticity values to be selected become apparent in the windows 5, 6, 7, and 8, with the values for midsize normal and plus rackets shown in windows 7 and 8 and the values for oversize normal and plus rackets shown in windows 6 and 5.

Figure 2:
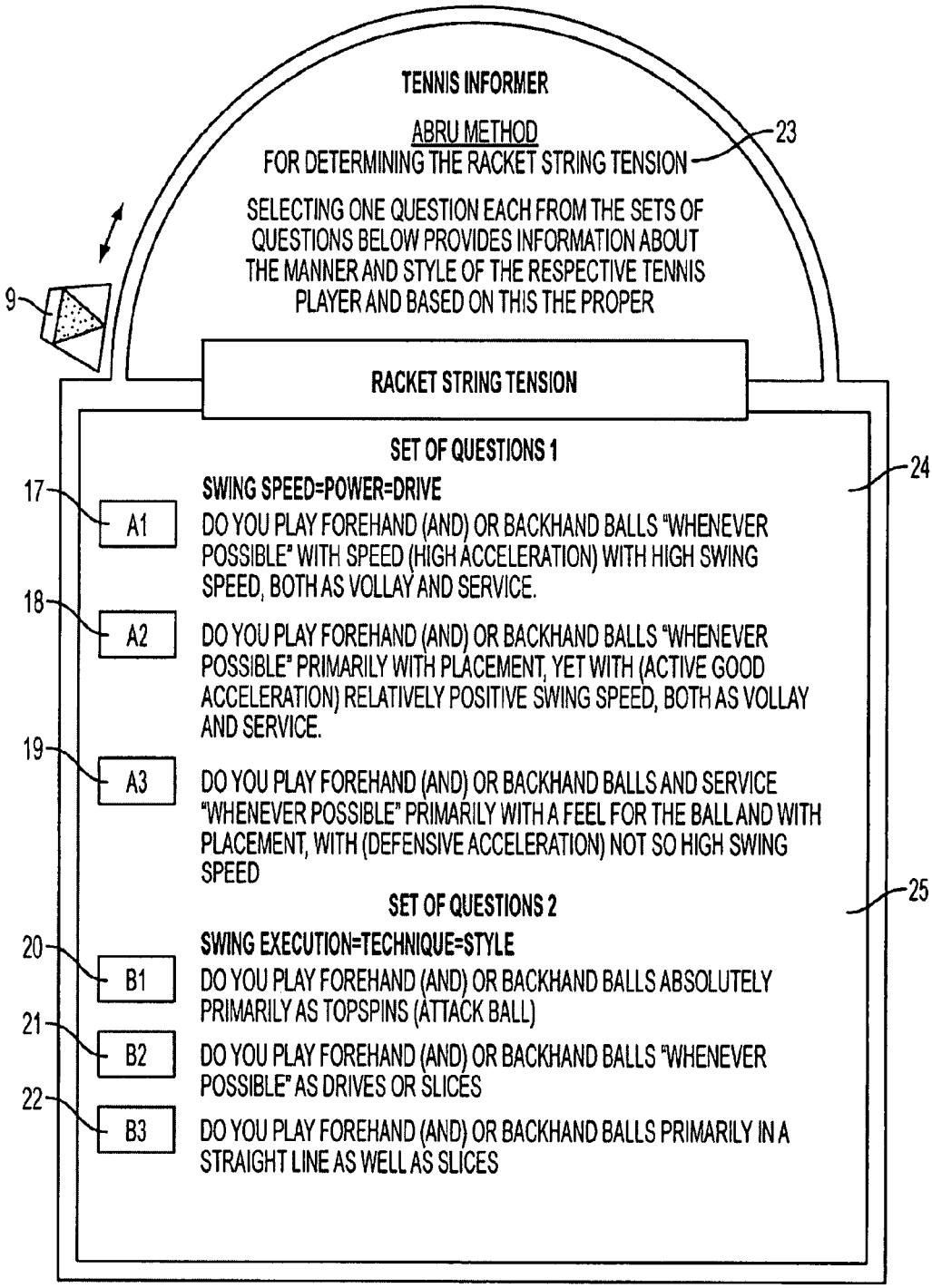
FIG. 2 is an illustration of the back of a device in accordance with some embodiments.

FIG. 2 illustrates the rear side of the device with the bottom part A of the body 4 with its leg C. The side viewed at of the leg C gives information on the selection of the individual settings of the racket stringing elasticity.

Figure 3:
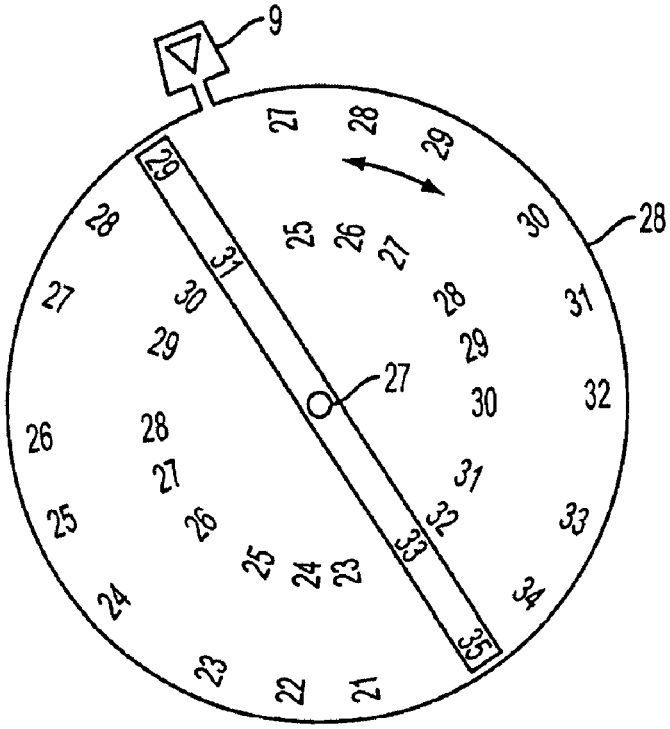
FIG. 3 is an illustration of a disc of a device in accordance with some embodiments.
Figure 4:
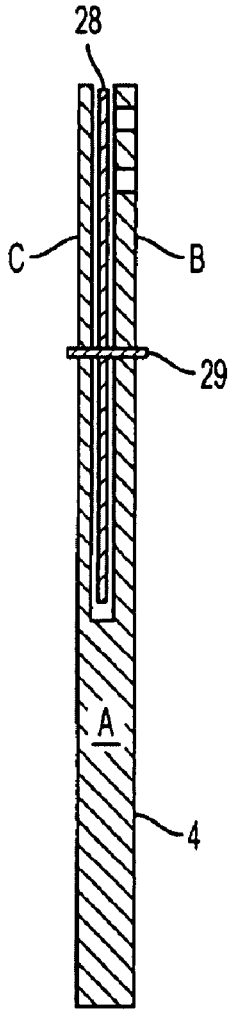
FIG. 4 is an cross-sectional illustration of a device in accordance with some embodiments.

FIG. 3 shows the rotary disc 28 with the rotary head 9 and the hole 27 for the axis 29. The rotary disc is provided with the printed values which are displayed in the windows 5, 6, 7, and 8 when rotating the disc. The construction of the device is illustrated by means of a sectional view.

Using this device may result in a reduction of physical wear on players and the resultant condition "tennis arm" or "tennis elbow."

Besides, the new device is capable of lessening the wear of existing tennis rackets that are still intact, thus contributing to relieving the environmental load of discarded tennis rackets.

The following reference numerals are used throughout the figures: 1—index range A1 for offensive players; 2—index range A2 for allround players; 3—index range A3 for defensive players; 4—body, basic element; 5, 6, 7, 8—windows for display of rotating disc index numbers; 9—rotary head of the rotary disc 28; 10—partition mark illustrating the playing mode ranges; 11, 12, 13, 14—reference features relating to the rotating disc index numbers 5, 6, 7, 8; 15—aperture; 16—note for racket acquisition; 17, 18, 19—FIG. 2 question block 1 regarding the choice of the individual racket stringing elasticity; 20, 21, 22—FIG. 2 question block 2 regarding the choice of the individual racket stringing elasticity; 23—FIG. 2 reference to playing type and mode; 21 to 35—FIG. 3 outer circle: stringing elasticity, depending on the racket head size and on the individual player characteristics; 23 to 33—FIG. 3 inner circle: stringing elasticity, depending on the racket head size and on the individual player characteristics; 28—rotary disc; 29—rotary disc axis; A—body, bottom part; B—front leg of A; and C—rear leg of A.

Although the invention has been described and illustrated in the foregoing illustrative embodiments, it is understood that the present disclosure has been made only by way of example, and that numerous changes in the details of implementation of the invention can be made without departing from the spirit and scope of the invention, which is only limited by the claims which follow. Features of the disclosed embodiments can be combined and rearranged in various ways.

What is claimed is:

1. A device for determining the string tension of racket strings comprising:

a body having a front surface indicating different combinations of player and racket characteristics, windows corresponding to certain types of rackets, and an axis perpendicular to the front surface; and a rotary disc which is rotatably situated on the axis behind the front surface and which has numbers indicated thereon representing racket string tension values that can be viewed through the windows for the different combinations of player and racket characteristics.

2. The device of claim 1, wherein the different combinations of player and racket characteristics include different player types.

3. The device of claim 2, wherein the different player types include at least one of offensive, allround, and defensive.

4. The device of claim 2, wherein the different player types include at least one of topspin player, drives or slices player, and straight line and slices player.

5. The device of claim 1, wherein the different combinations of player and racket characteristics include different racket sizes.

6. The device of claim 5, wherein the different racket sizes include at least one of midsize normal, midsize plus, oversize normal, and oversize plus.

* * * * *